US011147335B2

(12) United States Patent
Pomering et al.

(10) Patent No.: US 11,147,335 B2
(45) Date of Patent: Oct. 19, 2021

(54) HELMET

(71) Applicant: MIPS AB, Täby (SE)

(72) Inventors: Amy Louise Pomering, Täby (SE); Daniel Lanner, Täby (SE)

(73) Assignee: MIPS AB

( * ) Notice: Subject to any disclaimer, the term of this patent is extended or adjusted under 35 U.S.C. 154(b) by 271 days.

(21) Appl. No.: 16/468,856

(22) PCT Filed: Dec. 12, 2017

(86) PCT No.: PCT/EP2017/082473
§ 371 (c)(1),
(2) Date: Jun. 18, 2019

(87) PCT Pub. No.: WO2018/108940
PCT Pub. Date: Jun. 21, 2018

(65) Prior Publication Data

US 2019/0328074 A1 Oct. 31, 2019

(30) Foreign Application Priority Data

Dec. 14, 2016 (GB) ..... 1621272

(51) Int. Cl.
*A42B 3/32* (2006.01)
*A42B 3/06* (2006.01)

(52) U.S. Cl.
CPC ..... *A42B 3/324* (2013.01); *A42B 3/064* (2013.01)

(58) Field of Classification Search
CPC ..... A42B 3/064; A42B 3/32; A42B 3/324; A42B 3/124; A42B 3/14; A63B 71/10
See application file for complete search history.

(56) References Cited

U.S. PATENT DOCUMENTS 2,853,708 A 9/1958 Austin
2,861,274 A * 11/1958 Stuart ..... F41H 1/04 2/6.7
4,307,471 A 12/1981 Lovell
4,321,433 A 3/1982 Ashby
6,009,562 A 1/2000 Bullock et al.
6,032,297 A 3/2000 Barthold et al.
6,658,671 B1 * 12/2003 Von Holst ..... A42B 3/064 2/412

(Continued)

FOREIGN PATENT DOCUMENTS

CN 103238973 A 8/2013
DE 202011002121 U1 3/2011

(Continued)

*Primary Examiner* — Katherine M Moran
(74) *Attorney, Agent, or Firm* — Perkins Coie LLP

(57) ABSTRACT

According to an aspect of the present invention, there is provided a helmet comprising an inner shell (3) a detachable outer shell (2) and an intermediate layer (4) between the inner shell and the outer shell. At least one connecting member (5) is configured to directly connect the inner shell to the outer shell, and allow sliding between the inner shell and the outer shell, when the outer shell is attached to the helmet. When the outer shell is attached, the outer shell and the inner shell are configured to slide relative to one another in response to an impact. A sliding interface is provided between the intermediate layer and one or both of the outer shell and the inner shell.

20 Claims, 9 Drawing Sheets

(56) References Cited

U.S. PATENT DOCUMENTS

| | | | | |
|---|---|---|---|---|
| 8,166,573 | B1 | 5/2012 | Chung et al. | |
| 8,316,512 | B2 * | 11/2012 | Halldin | A42B 3/064 24/90.1 |
| 8,938,817 | B1 | 1/2015 | Baldi | |
| 10,143,258 | B2 * | 12/2018 | Salmini | A42B 3/127 |
| 2004/0250340 | A1 | 12/2004 | Piper et al. | |
| 2010/0043126 | A1 | 2/2010 | Morel | |
| 2011/0197327 | A1 | 8/2011 | McElroy et al. | |
| 2013/0042396 | A1 | 2/2013 | Wehtje | |
| 2014/0143937 | A1 | 5/2014 | Cram | |
| 2015/0089724 | A1 * | 4/2015 | Berry | A42B 3/064 2/414 |
| 2015/0101093 | A1 | 4/2015 | Occhipinti | |
| 2015/0313307 | A1 | 11/2015 | Wirthenstaetter et al. | |
| 2016/0316847 | A1 * | 11/2016 | Weber | A42B 3/064 |
| 2017/0188649 | A1 * | 7/2017 | Allen | A63B 71/10 |
| 2019/0297984 | A1 * | 10/2019 | Krynock | A42B 3/064 |
| 2019/0357623 | A1 * | 11/2019 | Willinger | A42B 3/064 |
| 2019/0373976 | A1 * | 12/2019 | Vos | A42B 3/064 |
| 2020/0323299 | A1 * | 10/2020 | Kele | A42B 3/127 |

FOREIGN PATENT DOCUMENTS

| | | | |
|---|---|---|---|
| JP | 2003-518203 | A | 6/2003 |
| JP | 2016-196727 | A | 11/2016 |
| WO | 0145526 | A1 | 6/2001 |
| WO | 2008046196 | A1 | 4/2008 |
| WO | 2011139224 | A1 | 11/2011 |
| WO | 2013000095 | A1 | 1/2013 |
| WO | 2016201183 | A1 | 12/2016 |

* cited by examiner

HELMET

RELATED APPLICATIONS

This application is a 35 USC § 371 National Stage application of International Application No. PCT/EP2017/082473, entitled "HELMET," filed on Dec. 12, 2017, which claims the benefit of United Kingdom Patent Application Number 1621272.2, filed Dec. 14, 2016, the disclosure of which are incorporated herein by reference in their entireties for all purposes.

The present invention relates to helmets. In particular, the invention relates to helmets in which an inner shell and an outer shell are able to slide relative to each other under an oblique impact.

Helmets are known for use in various activities. These activities include combat and industrial purposes, such as protective helmets for soldiers and hard-hats or helmets used by builders, mine-workers, or operators of industrial machinery for example. Helmets are also common in sporting activities. For example, protective helmets are used in ice hockey, cycling, motorcycling, motor-car racing, skiing, snow-boarding, skating, skateboarding, equestrian activities, American football, baseball, rugby, cricket, lacrosse, climbing, airsoft and paintballing.

Helmets can be of fixed size or adjustable, to fit different sizes and shapes of head. In some types of helmet, e.g. commonly in ice-hockey helmets, the adjustability can be provided by moving parts of the helmet to change the outer and inner dimensions of the helmet. This can be achieved by having a helmet with two or more parts which can move with respect to each other. In other cases, e.g. commonly in cycling helmets, the helmet is provided with an attachment device for fixing the helmet to the user's head, and it is the attachment device that can vary in dimension to fit the user's head whilst the main body or shell of the helmet remains the same size. Such attachment devices for seating the helmet on a user's head may be used together with additional strapping (such as a chin strap) to further secure the helmet in place. Combinations of these adjustment mechanisms are also possible.

Helmets are often made of an outer shell, that is usually hard and made of a plastic or a composite material, and an energy absorbing layer called a liner. Nowadays, a protective helmet has to be designed so as to satisfy certain legal requirements which relate to, inter alia, the maximum acceleration that may occur in the centre of gravity of the brain at a specified load. Typically, tests are performed, in which what is known as a dummy skull equipped with a helmet is subjected to a radial blow towards the head. This has resulted in modern helmets having good energy-absorption capacity in the case of blows radially against the skull. Progress has also been made (e.g. WO 2001/045526 and WO 2011/139224, which are both incorporated herein by reference, in their entireties) in developing helmets to lessen the energy transmitted from oblique blows (i.e. which combine both tangential and radial components), by absorbing or dissipating rotational energy and/or redirecting it into translational energy rather than rotational energy.

Such oblique impacts (in the absence of protection) result in both translational acceleration and angular acceleration of the brain. Angular acceleration causes the brain to rotate within the skull creating injuries on bodily elements connecting the brain to the skull and also to the brain itself.

Examples of rotational injuries include Mild Traumatic Brain Injuries (MTBI) such as concussion, and more severe traumatic brain injuries such as subdural haematomas (SDH), bleeding as a consequence of blood vessels rapturing, and diffuse axonal injuries (DAI), which can be summarized as nerve fibres being over stretched as a consequence of high shear deformations in the brain tissue.

Depending on the characteristics of the rotational force, such as the duration, amplitude and rate of increase, either concussion, SDH, DAI or a combination of these injuries can be suffered. Generally speaking, SDH occur in the case of accelerations of short duration and great amplitude, while DAI occur in the case of longer and more widespread acceleration loads.

Helmets are known in which an inner shell and an outer shell are able to slide relative to each other under an oblique impact to mitigate against injuries caused by angular components of acceleration (e.g. WO 2001/045526 and WO 2011/139224). However, prior art helmets do not allow an outer shell to be detached while also allowing sliding. This can be useful for many reasons, including replacing damaged parts while keeping those parts that are not damaged. The present invention aims to at least partially address this problem.

According to the invention, there is provided a helmet comprising an inner shell, a detachable outer shell, and an intermediate layer between the inner shell and the outer shell. When the outer shell is attached, the outer shell and the inner shell are configured to slide relative to one another in response to an impact. A sliding interface is provided between the intermediate layer and one or both of the outer shell and the inner shell.

According to a first aspect of the invention, the at least one connecting member directly connects the inner shell to the outer shell when the outer shell is attached to the helmet.

Optionally at least one of the inner shell and the outer shell is detachably connected to the at least one connecting member.

Optionally, the intermediate layer has a hole associated with each of the at least one connecting members and the helmet is configured such that each connecting member between the inner and outer shell passes through the associated hole.

Optionally, each hole is large enough to allow sliding between the inner shell and the outer shell during an impact without a connecting member passing through it making contact with the edge of the hole.

Optionally, a sliding interface is provided between the intermediate layer and the outer shell; and the helmet is configured such that intermediate layer remains in a fixed position relative to the inner shell during an impact. Alternatively, a sliding interface may be provided between the intermediate layer and the inner shell; and the helmet may be configured such that the intermediate layer remains in a fixed position relative to the outer shell during an impact.

According to a second aspect of the invention, the intermediate layer may be formed from or coated with a low friction material against which the outer shell and/or inner shell are configured to slide, and the at least one connecting member may be configured to directly connect the intermediate layer to one of the inner and outer shells; and the helmet may further comprise at least one connector configured to directly connect the intermediate layer to the other of the inner shell and the outer shell.

According to a first example of the second aspect of the invention, the at least one connecting member directly connects the inner shell to the intermediate layer.

Optionally, the outer shell is detachably connected to the intermediate layer. Alternatively, or additionally the at least one of the inner shell and the intermediate layer may be detachably connected to the at least one connecting member.

According to a second example of the second aspect of the invention, the at least one connecting member directly connects the outer shell to the intermediate layer.

Optionally, at least one of the outer shell and the intermediate layer is detachably connected to the at least one connecting member. Alternatively or additionally, the intermediate layer may be detachably connected to the inner shell.

Optionally, in helmets according to the first or second examples of the second aspect of the invention the at least one connector may be configured to fix the position of the intermediate layer relative to the other of the inner shell and the outer shell, when the outer shell is attached to the helmet. Alternatively, the at least one connector may be configured to allow sliding between the intermediate layer and the other one of the inner shell and the outer shell, when the outer shell is attached to the helmet. Optionally, in the helmets of any of the above aspects a sliding interface may be provided between the intermediate layer and both the inner and outer shells.

Optionally, in the helmets of any of the above aspects the intermediate layer may be formed from or coated with low friction material against which the outer shell and/or inner shell are configured to slide.

Optionally, in the helmets of any of the above aspects the outer shell may be formed from a hard material relative to the inner shell.

Optionally, in the helmets of any of the above aspects the inner shell may comprise an energy absorbing material configured to absorb impact energy by compression.

The invention is described below by way of non-limiting examples, with reference to the accompanying drawings, in which.

Figure 1:
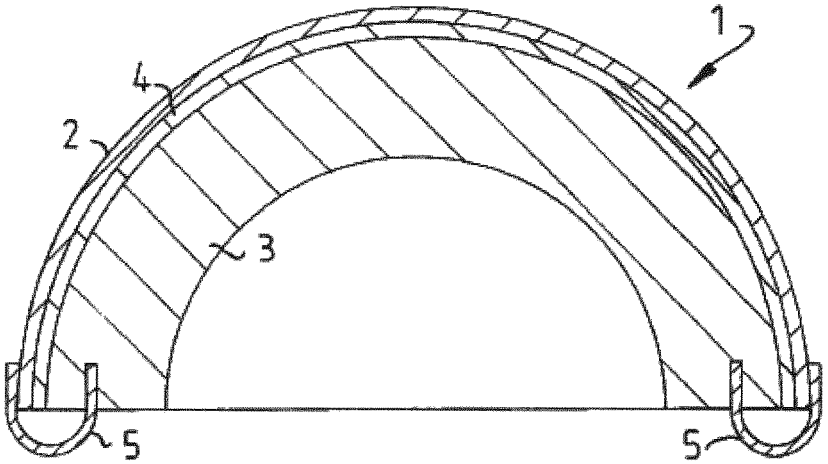
FIG. 1 depicts a cross section through a helmet for providing protection against oblique impacts.

The proportions of the thicknesses of the various layers and spacing between the layers in the helmets depicted in the figures have been exaggerated in the drawings for the sake of clarity and can of course be adapted according to need and requirements.

FIG. 1 depicts a first helmet 1 of the sort discussed in WO 01/45526, intended for providing protection against oblique impacts. This type of helmet could be any of the types of helmet discussed above.

Protective helmet 1 is constructed with an outer shell 2 and, arranged inside the outer shell 2, an inner shell 3. An additional attachment device may be provided that is intended for contact with the head of the wearer.

Arranged between the outer shell 2 and the inner shell 3 is an intermediate layer 4 or a sliding facilitator, and thus makes possible displacement between the outer shell 2 and the inner shell 3. In particular, as discussed below, an intermediate layer 4 or sliding facilitator may be configured such that sliding may occur between two parts during an impact. For example, it may be configured to enable sliding under forces associated with an impact on the helmet 1 that is expected to be survivable for the wearer of the helmet 1. In some arrangements, it may be desirable to configure the sliding layer or sliding facilitator such that the coefficient of friction is between 0.001 and 0.3 and/or below 0.15.

Arranged in the edge portion of the helmet 1, in the FIG. 1 depiction, may be one or more connecting members 5 which interconnect the outer shell 2 and the inner shell 3. In some arrangements, the connecting members may counteract mutual displacement between the outer shell 2 and the inner shell 3 by absorbing energy. However, this is not essential. Further, even where this feature is present, the amount of energy absorbed is usually minimal in comparison to the energy absorbed by the inner shell 3 during an impact. In other arrangements, connecting members 5 may not be present at all.

Further, the location of these connecting members 5 can be varied. For example, the connecting members may be positioned away from the edge portion, and connect the outer shell 2 and the inner shell 3 through the intermediate layer 4

The outer shell 2 may be relatively thin and strong so as to withstand impact of various types. The outer shell 2 could be made of a polymer material such as polycarbonate (PC), polyvinylchloride (PVC) or acrylonitrile butadiene styrene (ABS) for example. Advantageously, the polymer material can be fibre-reinforced, using materials such as glass-fibre, Aramid, Twaron, carbon-fibre, Kevlar or ultrahigh molecular weight polyethylene (UHMWPE).

The inner shell 3 is considerably thicker and acts as an energy absorbing layer. As such, it is capable of damping or absorbing impacts against the head. It can advantageously be made of foam material like expanded polystyrene (EPS), expanded polypropylene (EPP), expanded polyurethane (EPU), vinyl nitrile foam; or other materials forming a honeycomb-like structure, for example; or strain rate sensitive foams such as marketed under the brand-names Poron™ and D3O™. The construction can be varied in different ways, which emerge below, with, for example, a number of layers of different materials.

Inner shell 3 is designed for absorbing the energy of an impact. Other elements of the helmet 1 will absorb that energy to a limited extend (e.g. the hard outer shell 2 or so-called 'comfort padding' provided within the inner shell 3), but that is not their primary purpose and their contribution to the energy absorption is minimal compared to the energy absorption of the inner shell 3. Indeed, although some other elements such as comfort padding may be made of 'compressible' materials, and as such considered as 'energy absorbing' in other contexts, it is well recognised in the field of helmets that compressible materials are not necessarily 'energy absorbing' in the sense of absorbing a meaningful amount of energy during an impact, for the purposes of reducing the harm to the wearer of the helmet.

A number of different materials and embodiments can be used as the intermediate layer 4 or sliding facilitator, for example oil, gel, Teflon, microspheres, air, rubber, polycarbonate (PC), a fabric material such as felt, etc. Such a layer may have a thickness of roughly 0.1-5 mm, but other thicknesses can also be used, depending on the material selected and the performance desired. A layer of low friction plastics material such as PC is preferable for the intermediate layer 4. This may be moulded to the inside surface of the outer shell 2 (or more generally the inside surface of whichever layer it is directly radially inward of), or moulded to the outer surface of the inner shell 3 (or more generally the outside surface of whichever layer it is directly radially outward of). The number of intermediate layers and their positioning can also be varied, and an example of this is discussed below (with reference to FIG. 3B).

As connecting members 5, use can be made of, for example, deformable strips of rubber, plastic or metal. These may be anchored in the outer shell and the inner shell in a suitable manner.

Figure 2:
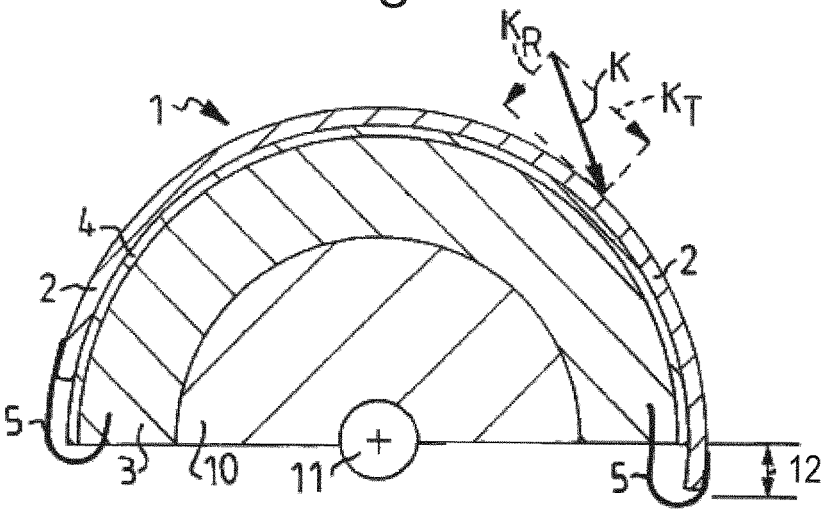
FIG. 2 is a diagram showing the functioning principle of the helmet of FIG. 1.

FIG. 2 shows the functioning principle of protective helmet 1, in which the helmet 1 and a skull 10 of a wearer are assumed to be semi-cylindrical, with the skull 10 being mounted on a longitudinal axis 11. Torsional force and torque are transmitted to the skull 10 when the helmet 1 is subjected to an oblique impact K. The impact force K gives rise to both a tangential force $K_T$ and a radial force $K_R$ against the protective helmet 1. In this particular context, only the helmet-rotating tangential force $K_T$ and its effect are of interest.

As can be seen, the force K gives rise to a displacement 12 of the outer shell 2 relative to the inner shell 3, the connecting members 5 being deformed. A reduction in the torsional force transmitted to the skull 10 of up to around 75%, and on average roughly 25% can be obtained with such an arrangement. This is a result of the sliding motion between the inner shell 3 and the outer shell 2 reducing the amount of rotational energy otherwise transferred to the brain.

Sliding motion can also occur in the circumferential direction of the protective helmet 1, although this is not depicted. This can be as a consequence of circumferential angular rotation between the outer shell 2 and the inner shell 3 (i.e. during an impact the outer shell 2 can be rotated by a circumferential angle relative to the inner shell 3). Although FIG. 2 shows the intermediate layer 4 remaining fixed relative to the inner shell 3 while the outer shell slides, alternatively, the intermediate layer 4 may remain fixed relative to the outer shell 2 while the inner shell 3 slides relative to the intermediate layer 4. Alternatively still, the both the outer shell 2 and inner shell 3 may slide relative to the intermediate layer 4.

Figure 3A:
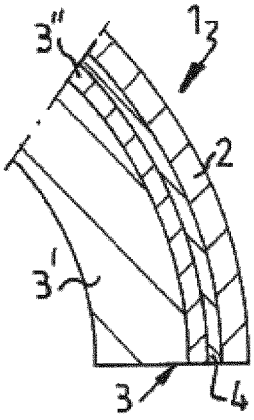
FIGS. 3A, 3B & 3C show variations of the structure of the helmet of FIG. 1.
Figure 3B:
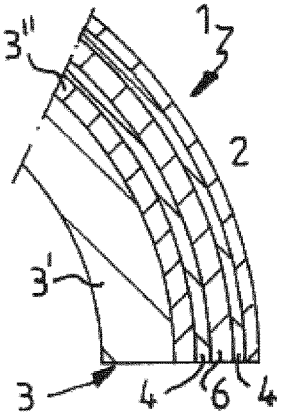
Figure 3C:
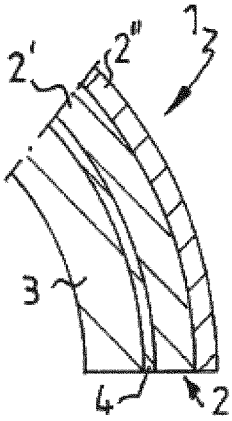

Other arrangements of the protective helmet 1 are also possible. A few possible variants are shown in FIG. 3. In FIG. 3*a*, the inner shell 3 is constructed from a relatively thin outer layer 3" and a relatively thick inner layer 3'. The outer layer 3" may be harder than the inner layer 3', to help facilitate the sliding with respect to outer shell 2. In FIG. 3*b*, the inner shell 3 is constructed in the same manner as in FIG. 3*a*. In this case, however, there are two intermediate layers 4, between which there is an intermediate shell 6. The two intermediate layers 4 can, if so desired, be embodied differently and made of different materials. One possibility, for example, is to have lower friction in the outer intermediate layer than in the inner. In FIG. 3*c*, the outer shell 2 is embodied differently to previously. In this case, a harder outer layer 2" covers a softer inner layer 2'. The inner layer 2' may, for example, be the same material as the inner shell 3. Although, FIGS. 1 to 3 show no separation in a radial direction between the layers, there may be some separation between layers, such that a space is provided, in particular between layers configured to slide relative to each other.

Figure 4:
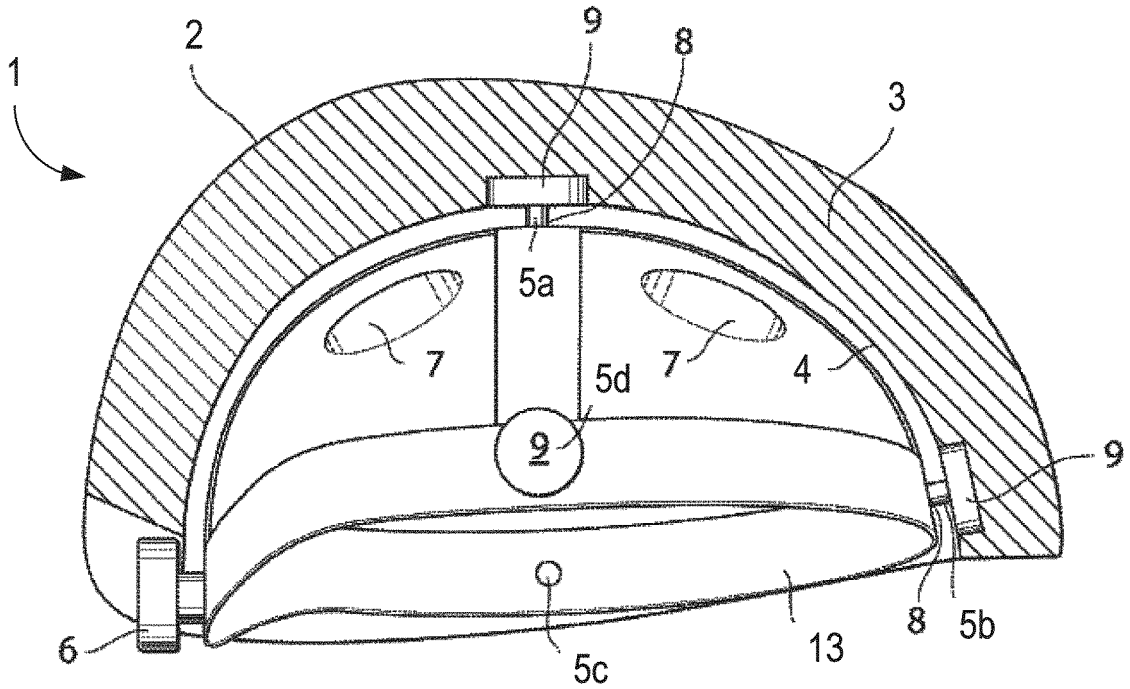
FIG. 4 is a schematic drawing of a another protective helmet.

FIG. 4 depicts a second helmet 1 of the sort discussed in WO 2011/139224, which is also intended for providing protection against oblique impacts. This type of helmet could also be any of the types of helmet discussed above.

In FIG. 4, helmet 1 comprises an energy absorbing layer 3, similar to the inner shell 3 of the helmet of FIG. 1. The outer surface of the energy absorbing layer 3 may be provided from the same material as the energy absorbing layer 3 (i.e. there may be no additional outer shell), or the outer surface could be a rigid shell 2 (see FIG. 5) equivalent to the outer shell 2 of the helmet shown in FIG. 1. In that case, the rigid shell 2 may be made from a different material than the energy absorbing layer 3. The helmet 1 of FIG. 4 has a plurality of vents 7, which are optional, extending through both the energy absorbing layer 3 and the outer shell 2, thereby allowing airflow through the helmet 1.

An attachment device 13 is provided, for attachment of the helmet 1 to a wearer's head. As previously discussed, this may be desirable when energy absorbing layer 3 and rigid shell 2 cannot be adjusted in size, as it allows for the different size heads to be accommodated by adjusting the size of the attachment device 13. The attachment device 13 could be made of an elastic or semi-elastic polymer material, such as PC, ABS, PVC or PTFE, or a natural fibre material such as cotton cloth. For example, a cap of textile or a net could form the attachment device 13.

Although the attachment device 13 is shown as comprising a headband portion with further strap portions extending from the front, back, left and right sides, the particular configuration of the attachment device 13 can vary according to the configuration of the helmet. In some cases the attachment device may be more like a continuous (shaped) sheet, perhaps with holes or gaps, e.g. corresponding to the positions of vents 7, to allow air-flow through the helmet.

FIG. 4 also depicts an optional adjustment device 6 for adjusting the diameter of the head band of the attachment device 13 for the particular wearer. In other arrangements, the head band could be an elastic head band in which case the adjustment device 6 could be excluded.

A sliding facilitator 4 is provided radially inwards of the energy absorbing layer 3. The sliding facilitator 4 is adapted to slide against the energy absorbing layer or against the attachment device 13 that is provided for attaching the helmet to a wearer's head.

The sliding facilitator 4 is provided to assist sliding of the energy absorbing layer 3 in relation to an attachment device 13, in the same manner as discussed above. The sliding facilitator 4 may be a material having a low coefficient of friction, or may be coated with such a material.

As such, in the FIG. 4 helmet, the sliding facilitator may be provided on or integrated with the innermost sided of the energy absorbing layer 3, facing the attachment device 13.

However, it is equally conceivable that the sliding facilitator 4 may be provided on or integrated with the outer surface of the attachment device 13, for the same purpose of providing slidability between the energy absorbing layer 3 and the attachment device 13. That is, in particular arrangements, the attachment device 13 itself can be adapted to act as a sliding facilitator 5 and may comprise a low friction material.

In other words, the sliding facilitator 4 is provided radially inwards of the energy absorbing layer 3. The sliding facilitator can also be provided radially outwards of the attachment device 13.

When the attachment device 13 is formed as a cap or net (as discussed above), sliding facilitators 4 may be provided as patches of low friction material.

The low friction material may be a waxy polymer, such as PTFE, ABS, PVC, PC, Nylon, PFA, EEP, PE and UHMWPE, or a powder material which could be infused with a lubricant. The low friction material could be a fabric material. As discussed, this low friction material could be applied to either one, or both of the sliding facilitator and the energy absorbing layer The attachment device 13 can be fixed to the energy absorbing layer 3 and/ or the outer shell 2 by means of fixing members 5, such as the four fixing members 5*a*, 5*b*, 5*c* and 5*d* in FIG. 4. These may be adapted to absorb energy by deforming in an elastic, semi-elastic or plastic way. However, this is not essential. Further, even where this feature is present, the amount of energy absorbed is usually minimal in comparison to the energy absorbed by the energy absorbing layer 3 during an impact.

According to the embodiment shown in FIG. 4 the four fixing members 5*a*, 5*b*, 5*c* and 5*d* are suspension members 5*a*, 5*b*, 5*c*, 5*d*, having first and second portions 8, 9, wherein the first portions 8 of the suspension members 5*a*, 5*b*, 5*c*, 5*d* are adapted to be fixed to the attachment device 13, and the second portions 9 of the suspension members 5*a*, 5*b*, 5*c*, 5*d* are adapted to be fixed to the energy absorbing layer 3.

Figure 5:
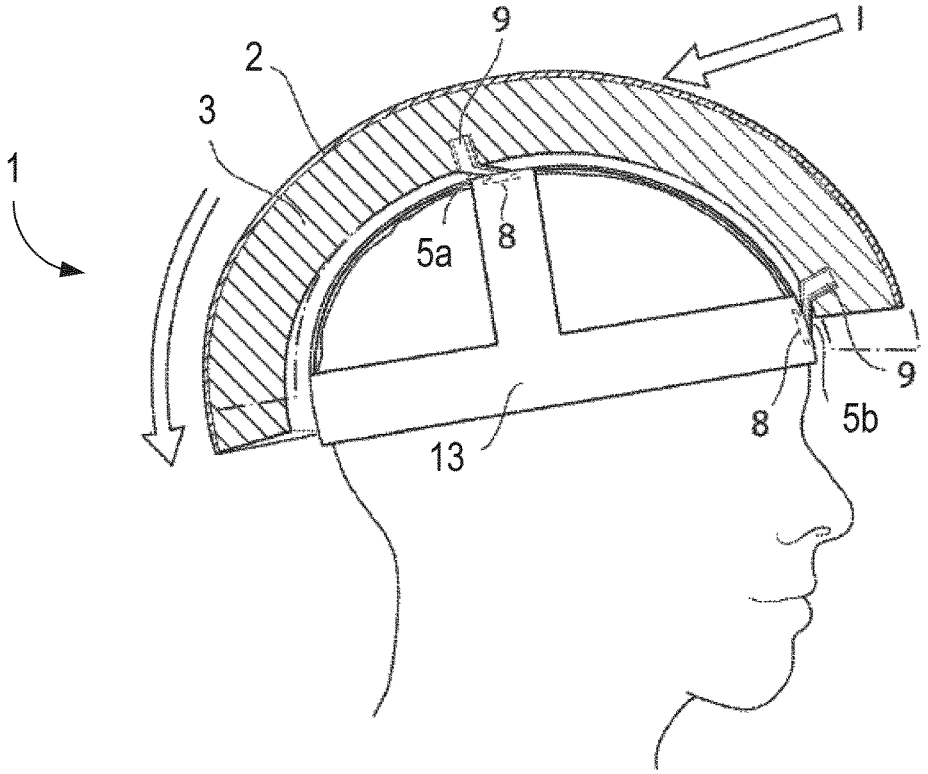
FIG. 5 depicts an alternative way of connecting the attachment device of the helmet of FIG. 4.

FIG. 5 shows an embodiment of a helmet similar to the helmet in FIG. 4, when placed on a wearers' head. The helmet 1 of FIG. 5 comprises a hard outer shell 2 made from a different material than the energy absorbing layer 3. In contrast to FIG. 4, in FIG. 5 the attachment device 13 is fixed to the energy absorbing layer 3 by means of two fixing members 5*a*, 5*b*, which are adapted to absorb energy and forces elastically, semi-elastically or plastically.

A frontal oblique impact I creating a rotational force to the helmet is shown in FIG. 5. The oblique impact I causes the energy absorbing layer 3 to slide in relation to the attachment device 13. The attachment device 13 is fixed to the energy absorbing layer 3 by means of the fixing members 5*a*, 5*b*. Although only two such fixing members are shown, for the sake of clarity, in practice many such fixing members may be present. The fixing members 5 can absorb the rotational forces by deforming elastically or semi-elastically. In other arrangements, the deformation may be plastic, even resulting in the severing of one or more of the fixing members 5. In the case of plastic deformation, at least the fixing members 5 will need to be replaced after an impact. In some case a combination of plastic and elastic deformation in the fixing members 5 may occur, i.e. some fixing members 5 rupture, absorbing energy plastically, whilst other fixing members 5 deform and absorb forces elastically.

In general, in the helmets of FIG. 4 and FIG. 5, during an impact the energy absorbing layer 3 acts as an impact absorber by compressing, in the same way as the inner shell of the FIG. 1 helmet. If an outer shell 2 is used, it will help spread out the impact energy over the energy absorbing layer 3. The sliding facilitator 4 will also allow sliding between the attachment device and the energy absorbing layer. This allows for a controlled way to dissipate energy that would otherwise be transmitted as rotational energy to the brain. The energy can be dissipated by friction heat, energy absorbing layer deformation or deformation or displacement of the fixing members. The reduced energy transmission results in reduced rotational acceleration affecting the brain, thus reducing the rotation of the brain within the skull. The risk of rotational injuries including MTBI and more severe traumatic brain injuries such as subdural haematomas, SDH, blood vessel rapturing, concussions and DAI is thereby reduced.

Figure 6:
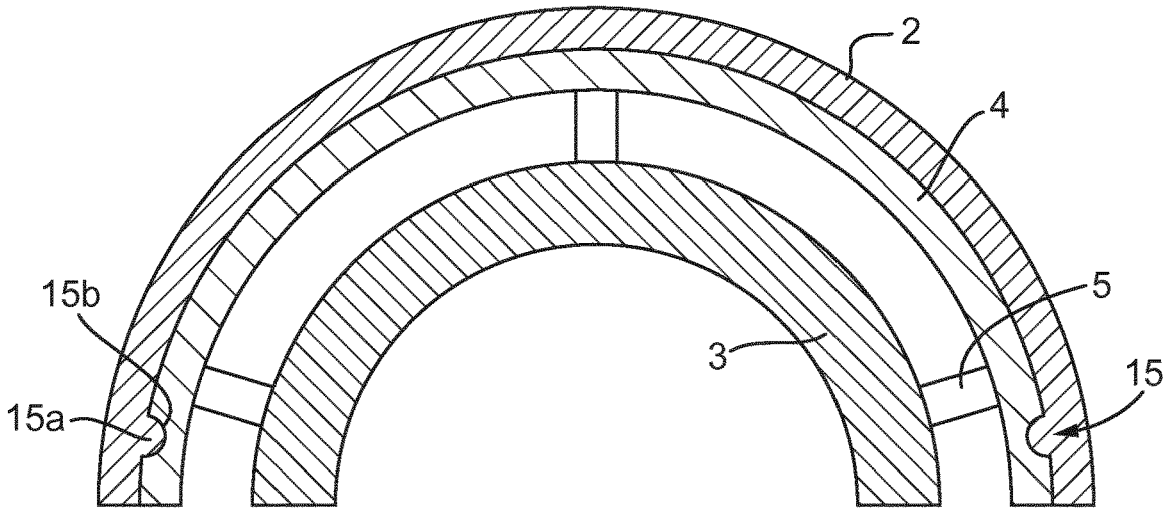
FIG. 6 shows a helmet in accordance with a first embodiment.

FIG. 6 shows a first embodiment of a helmet 1 in accordance with the present invention. The helmet 1 comprises an inner shell 3, a detachable outer shell 2 and an intermediate layer 4 between the inner shell 3 and the outer shell 2. It should be noted that the spacing between these helmet parts shown in FIG. 6 (and subsequent figures) is exaggerated. For example, in practice the helmet parts may be in contact. When the outer shell 2 is attached, the outer shell 2 and the inner shell 3 are configured to slide relative to one another in response to an impact. A sliding interface is provided between the intermediate layer 4 the inner shell 3. The detachability of the outer shell from the rest of the helmet allows replacement of specific parts of the helmet, for example, those for which the functional integrity is compromised, while retaining specific parts of the helmet, for example, those for which the functional integrity is not compromised. Therefore, unnecessary wastage of helmet parts can be avoided.

The intermediate layer 4 is formed from a low friction material, against which the inner shell 3 is configured to slide. For example, the low friction material may be PC, although any of the alternatives described above may be used instead. The inner shell 3 may comprise an energy absorbing material configured to absorb impact energy by compression. For example, the energy absorbing material may be formed from EPP, although any of the alternatives described above may be used instead. The outer shell 2 may be formed from a material that is hard relative to the inner shell 3. For example, the outer shell 2 may be formed from Kevlar, although any of the alternatives described above may be used instead.

The helmet 1 may comprise a plurality of connecting members 5 used to connect the inner shell 3 and the outer shell 2. The connecting members 5 may be configured to allow sliding between the inner shell 3 and the outer shell 2, when the outer shell 2 is attached to the helmet 1. Specifically, the connecting members 5 may be deformable to permit sliding between the inner shell 3 and the outer shell 2. For example, the connecting members 5 may connect the inner shell 3 and outer shell 2 indirectly, the connecting members may directly connect the inner shell 3 to the intermediate layer 4 (as shown in FIG. 6). The connecting members 5 may be configured to allow sliding in any direction, e.g. any direction parallel to a surface of the outer shell 2 or inner shell 3, at which sliding occurs relative to the other of the outer shell 2 or inner shell 3.

In the present embodiment, the outer shell 2 is detachably connected to the intermediate layer 4. The intermediate layer 4 is configured to remain in a fixed position relative to the outer shell 2 during an impact, fixed by the detachable connection to the outer shell 2. For example, the detachable connecting means 15 shown in FIGS. 7 to 14 and described below may be used. In each case, one ore more detachable connecting means 15 may be provided at different locations around the edge of the helmet. The detachable connection may be a snap fit connection.

Figure 7:
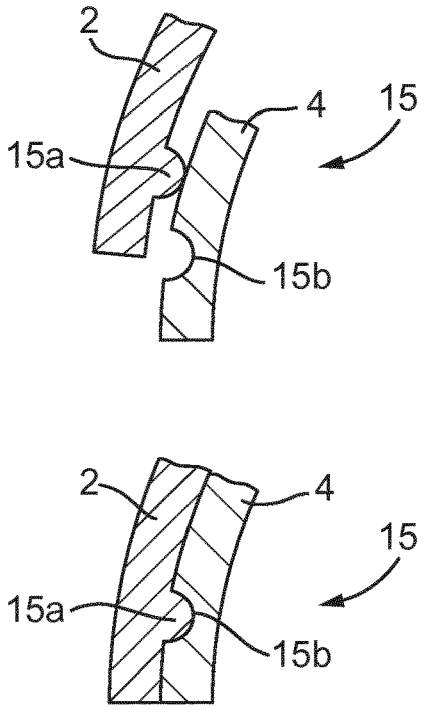
FIGS. 7 to 14 show examples of a detachable connection between the outer shell and the intermediate layer.

As shown in the example of FIG. 7, the detachable connecting means 15 may comprise a convex portion 15*a* in the inner surface of the outer shell 2 and a corresponding concave portion 15*b* in the outer surface of the intermediate layer 4.

In order to attach the outer shell 2 to the intermediate layer 4, the outer shell 2 is pushed onto the inner shell 3 until the convex portion 15*a* and the concave portion 15*b* are aligned, at which point the convex portion 15*a* snaps into the concave portion 15*b*. Until the convex portion 15*a* and the concave portion 15*b* are aligned, the intermediate layer 4 and/or the outer shell 2 are deformed by the pressure of the convex portion 15*a* against the outer surface of the intermediate layer 4. Thus the "snap" occurs when the intermediate layer 4 and/or the outer shell 2 become less deformed when the convex portion 15*a* and the concave portion 15*b* are aligned.

The outer shell 2 can be detached by deforming the intermediate layer 4 and/or the outer shell 2 such that the convex portion 15*a* separates from the concave portion 15*b*. The convex portion 15*a* and/or concave portion 15*b* may have sloped sides. This may aid the separation of the convex portion 15*a* and the concave portion 15*b*. The detachable connecting means 15 may be provided near the edge of the helmet 1. Multiple such detachable connecting means may be provided around the helmet 1. Alternatively, the convex portion 15*a* and the concave portion 15*b* may be continuous around the edge of the helmet 1.

Instead of a concave portion 15*b*, a through hole may be provided in the intermediate layer 4 that engages with the convex portion 15*a* of the outer shell 2. The location of the convex portion 15*a* and concave portion 15*b* (or through hole) may be reversed. Accordingly, the convex portion 15*a* and the concave portion 15*b* (or through hole) may be provided on the outer surface of the intermediate layer and the inner surface of the outer shell 2, respectively.

Figure 8:
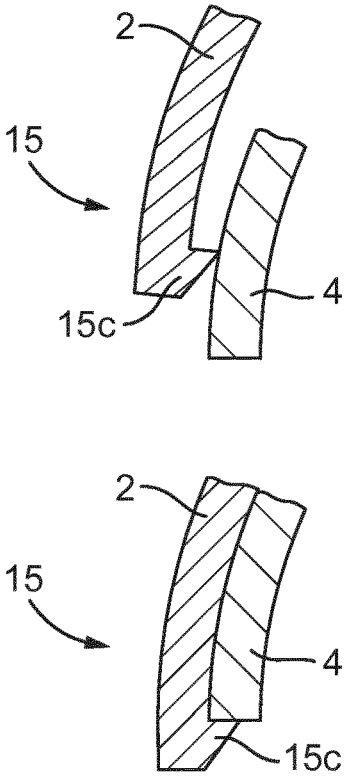

As shown in the example of FIG. 8, the detachable connecting means 15 may comprise a convex portion 15*c* in the inner surface of the outer shell 2. The convex portion 15*c* is arranged such that it is located at a position on the inner surface of the outer shell 2 corresponding to a position just below the edge of the intermediate layer 4. The convex portion 15*c* is configured to hook around the edge of the intermediate layer 4.

In order to attach the outer shell 2 to the intermediate layer 4, the outer shell 2 is pushed onto the inner shell 3 until the convex portion 15*c* reaches the edge of the intermediate layer 4, at which point the convex portion 15*c* snaps around the edge of the intermediate layer 4. Until the convex portion 15*c* reaches the edge of the intermediate layer 4, the intermediate layer and/or the outer shell are deformed by the pressure of the convex portion 15*c* against the outer surface of the intermediate layer 4, thus the "snap" occurs when the intermediate layer and/or the outer shell become less deformed when the convex portion 15*c* reaches the edge of the intermediate layer 4.

The outer shell 2 can be detached by applying sufficient force to deform the intermediate layer 4 and/or the outer shell 2 such that the convex portion 15*c* unhooks from the edge of intermediate layer 4. Multiple such detachable connecting means may be provided around the edge of the helmet 1. Alternatively, the convex portion 15*c* may be continuous around the edge of the helmet 1.

Figure 9:
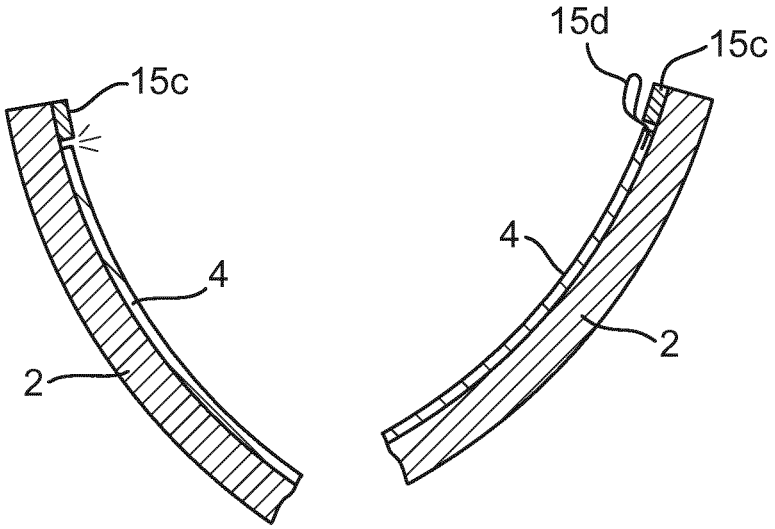

FIG. 9 shows a modification of the detachable connecting means 15 shown in FIG. 8. As shown in FIG. 9, the detachable connecting means 15 may additionally comprise a release member 15*d*. The release member 15*d*, e.g. a flexible strap, is connected to the edge of the intermediate layer 4 at a location at which the intermediate layer 4 is configured to snap fit with the outer shell 2. The release member 15*d* allows the user to more easily separate the intermediate layer 4 from the outer shell 2 by pulling the release member 15*d*. Pulling of the release member 15*d* applies a force to the intermediate layer 4 connected thereto so as to unhook the intermediate layer 4 from the convex portion 15*c* of the outer shell 2.

Figure 10:
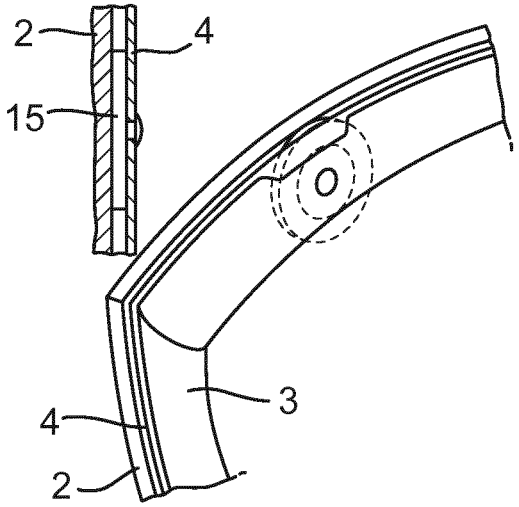

As shown in the example of FIG. 10, the detachable connection means 15 may comprise a protrusion connected to the outer shell 2 and configured to snap-fit with the intermediate layer 4 via a through-hole in the intermediate layer 4. A tip of the protrusion may be configured such that it deforms as it passes through the through-hole in the intermediate layer 4 then "snaps" back into its non-deformed state once the tip has passed through the through-hole. By applying a sufficient force to separate the intermediate layer from the outer shell 2, the tip of the protrusion can be deformed and passed back through the through-hole in order to detach the outer shell 2 from the intermediate layer 4.

As shown in FIG. 10, the protrusion may be attached to the inner surface of the outer shell 2, e.g. by a substantially flat mounting surface provided at the opposite end of the protrusion from the tip. The protrusion may be attached to the outer shell 2 by adhesive for example.

Also as shown in FIG. 10, the inner shell 3 may comprise an indented portion at a location corresponding to the detachable connecting means 15 in order to provide a space for the tip of the detachable connecting means 15 protruding through the intermediate layer 4.

Figure 11:
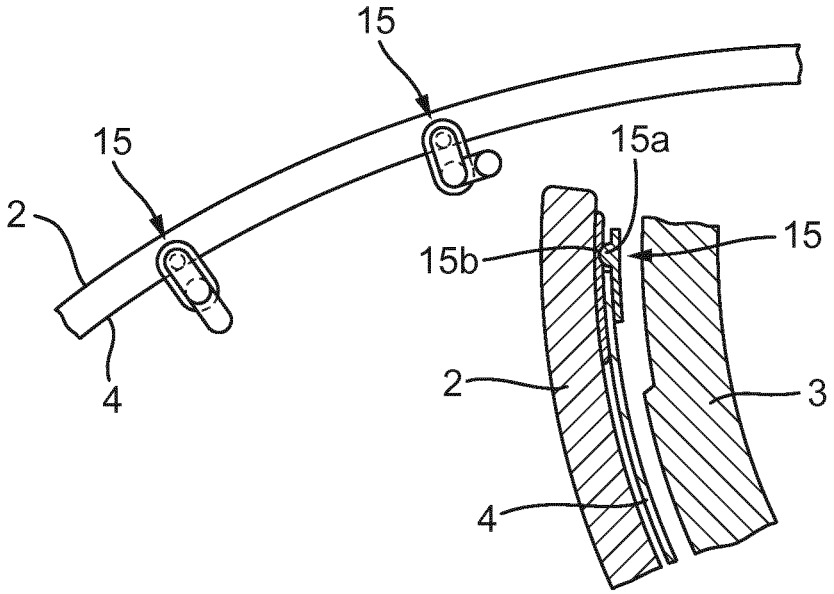

As shown in the example of FIG. 11, the detachable connecting means 15 may comprise a convex portion 15*a* associated with the intermediate layer 4 and a corresponding concave portion 15*b* associated with the outer shell 2. In the example shown in FIG. 11, the convex portion 15*a* is part of a rotating member attached to the intermediate layer 4, e.g. at the edge thereof. The rotating member is configured such that, by rotating the rotating member, the convex portion 15*a* moves in and out of the concave portion 15*b*, thus attaching/detaching the outer shell 2 from the intermediate layer 4.

As shown in FIG. 11, the concave portion 15*b* may be provided in a separate member attached to the inside surface of the outer shell 2 (e.g. by adhesive). However, the concave portion 15*b* may alternatively be provided in the outer shell 2 itself As shown in FIG. 11, the inner shell 3 may comprise an indented portion at a location corresponding to the detachable connecting means 15, to provide space for the rotating member of the detachable connecting means 15.

Figure 12:
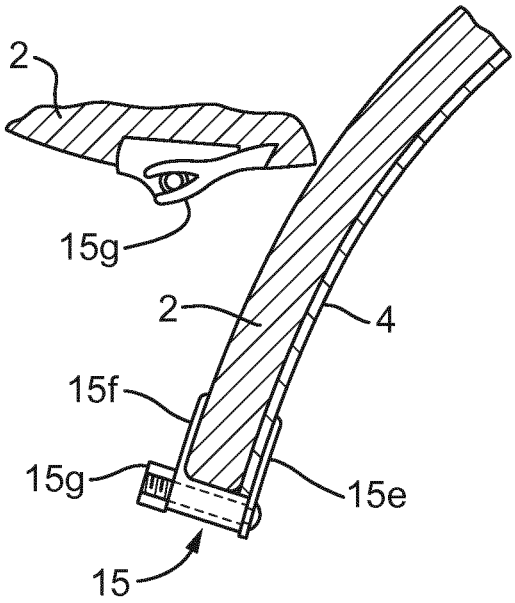

As shown in the example of FIG. 12, the detachable connecting means 15 may comprise first and second clamping elements 15*e*, 15*f* and a tightening means 15*g*. The first and second clamping elements 15*e*, 15*f* oppose each other with a gap therebetween configured to accommodate a portion of the outer shell 2 and a portion of the intermediate layer 4. The tightening means 15*g* is configured to apply a force in a direction that reduces the gap between the clamping elements 15*e* and 15*f* so as to clamp therebetween the portion of the outer shell 2 and the portion of the intermediate layer 4. Accordingly, the outer layer 2 and the intermediate layer 4 can be attached together. In order to detach the outer shell 2 from the intermediate layer 4, the tightening means 15*g* is loosened so that the outer shell 2 can be separated from the intermediate layer 4. One or more detachable connecting means 15 may be provided at different locations around the edge of the helmet.

As shown in FIG. 12, the tightening means 15*g* may comprise a lever connected to a screw passing through the first and second clamping elements 15*e* and 15*f*. As the lever is rotated, it moves along the thread of the screw, thus tightening the detachable connecting means 15.

Figure 13:
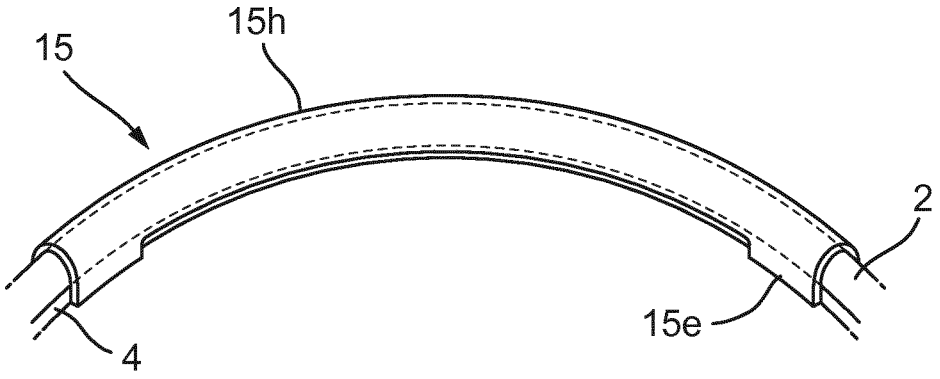

FIG. 13 shows a further example of a detachable connection means 15. This example is similar to the previous example in that it comprises first and second clamping elements 15*e*, 15*f* opposing one another with a gap provided therebetween for accommodating a portion of the outer shell 2 and a portion of the intermediate layer 4. However, instead of tightening means 15*g*, the detachable connecting means 15 further comprises a biasing means 15*h* configured to provide a biasing or spring force to clamp the outer shell 2 and the intermediate layer 4 between the clamping elements 15*e*, 15*f*.

As shown in FIG. 13, the detachable connecting means 15, comprising the clamping elements 15*e*, 15*f* and the biasing element 15*h*, may be formed as a single structure, for example from a material such as plastic.

Figure 14:
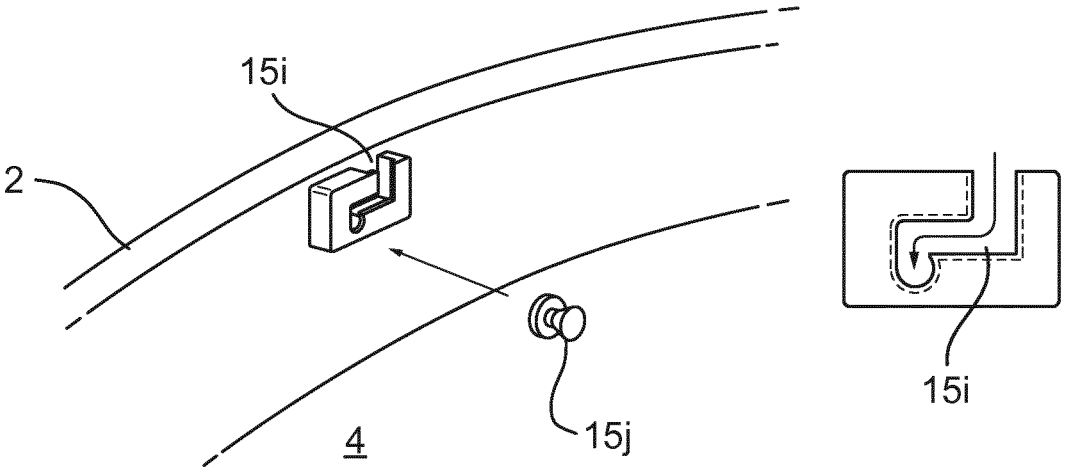

Another example of a detachable connecting means 15 is shown in FIG. 14. As shown in FIG. 14, the detachable connecting means 15 may comprise a protrusion 15*j* associated with the intermediate layer 4 and a channel 15*i* associated with the outer shell 2. The protrusion 15*j* is configured to engage with the channel 15*i*. The channel 15*i* may be substantially Z-shaped, with the protrusion 15*j* being configured to enter the channel 15*i* at one end of the Z-shape, said end being provided towards an edge of the outer shell 2. Accordingly, the protrusion 15*j* can be moved from one end of the Z-shaped channel 15*i* to the other end by moving the intermediate layer 4 relative to the outer shell 2. Accordingly the intermediate 4 can be locked in position relative to the outer shell 2 in a detachable way.

The protrusion 15*j* preferably includes a flange portion at a tip of the protrusion 15*j*. The channel preferably is configured to include a wider portion configured to accommodate the flange and a narrow portion such that the flange cannot pass through the narrow portion if the protrusion 15*j* is separated from the channel 15*i* in a longitudinal direction of the protrusion 15*j* (corresponding to the radial direction of the helmet of the location of the detachable connecting means 15). The wider portion is depicted by dashed lines in FIG. 14.

Figure 15:
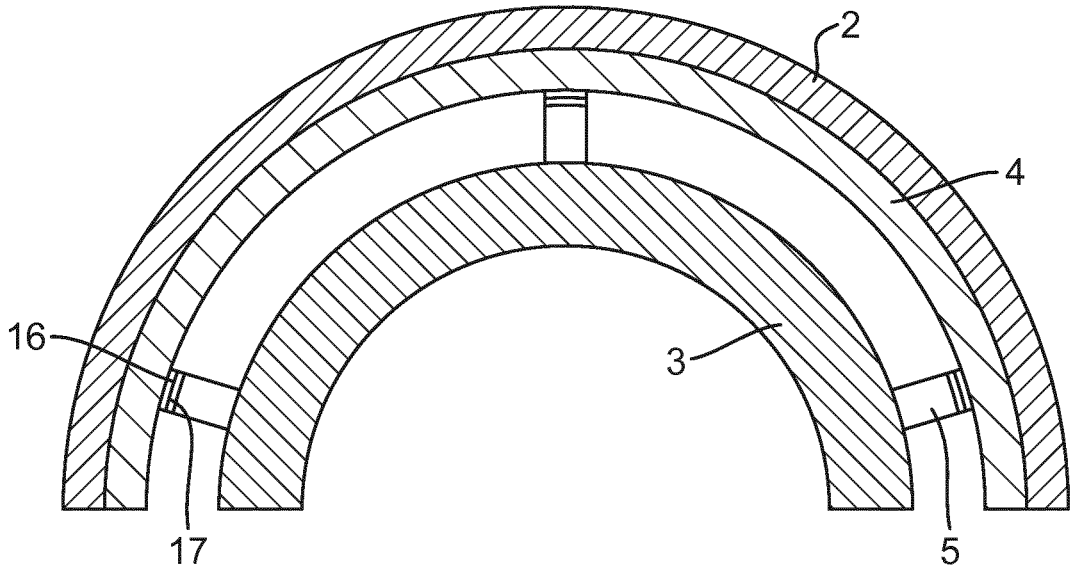
FIG. 15 shows a helmet in accordance with a second embodiment.

FIG. 15 shows a second embodiment of a helmet 1 in accordance with the present invention. The helmet 1 of the second embodiment is similar to the helmet 1 of the first embodiment in most aspects. However, the intermediate layer 4 is detachably connected to the connecting members 5. This may be alternative to, or additional to, the outer shell 2 being detachably connected to the intermediate layer 4, as described in relation to the first embodiment.

The connecting members 5 may be detachably attached to the intermediate layer 4 by a hook and loop detachable connecting means, e.g. Velcro™. However, any other suitable means may be used, for example, snap fit connection means. The hook and loop detachable connecting means comprises a looped part 16 and a hooked part 17. The looped part 16 may be attached to the connecting member 5 and the hooked part 17 may be attached to the inner shell 3. However, the opposite arrangement is equally suitable. The hooks of the hooked part 16 hook into the loops of the looped part 17 to provide a detachable connection. The looped part 16 and hooked part 17 may be attached to the connecting member 5 and inner shell 3, respectively, by any suitable means, e.g. adhesive. The connecting means 5 may be attached to the inner shell 3 by any suitable means, e.g. adhesive.

In a modification of the second embodiment (not shown in the figures), the inner shell 3 may be detachably connected to the connecting members 5, in the same way as described above. In this modification the connecting means 5 can be attached to the intermediate layer 4 by any suitable means, e.g. adhesive. Alternatively, both the inner shell 3 and intermediate layer 4 may be detachably connected to the connecting members 5, as described above.

Figure 16:
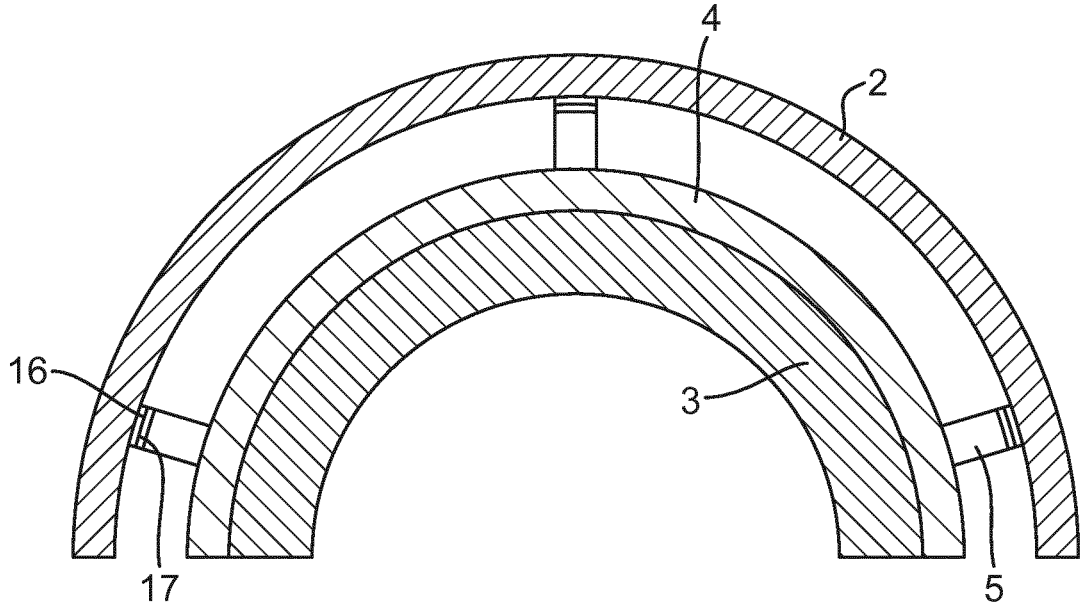
FIG. 16 shows a helmet in accordance with a third embodiment.

FIG. 16 shows a third embodiment of helmet 1 in accordance with the present invention. The helmet 1 of the third embodiment is similar to the helmet 1 of the first embodiment. However, the connecting members 5 directly connect the outer shell 2 to the intermediate layer 4 instead of directly connecting the inner shell 3 and the intermediate layer 4. For example, the outer shell 2 may be detachably connected to the connecting members 5. A sliding interface may be provided between the intermediate layer 4 and the outer shell 2. The helmet 1 may be configured such that intermediate layer 4 remains in a fixed position relative to the inner shell 3 during an impact.

The connecting members 5 may be detachably attached to the outer shell 2 by a hook and loop detachable connecting means, e.g. Velcro™. However, any other suitable means may be used, for example, snap fit connection means. The hook and loop detachable connecting means comprises a looped part 16 and a hooked part 17. In the embodiment shown in FIG. 10 the looped part 16 is attached to the connecting member 5 and the hooked part 17 is attached to the outer shell 2. However, the opposite arrangement is equally suitable. The hooks of the hooked part 16 hook into the loops of the looped part 17 to provide a detachable connection. The looped part 16 and hooked part 17 may be attached to the connecting member 5 and outer shell 2 respectively by any suitable means, e.g. adhesive. The connecting means 5 may be attached to the intermediate layer 4 by any suitable means, e.g. adhesive.

In a modification of the third embodiment (not shown in the figures), the intermediate layer 4 may be detachably connected to the connecting members 5, in the same way as described above. In this modification the connecting means 5 can be attached to the outer shell 2 by any suitable means, e.g. adhesive. Alternatively, both the outer shell 2 and intermediate layer 4 may be detachably connected to the connecting members 5, as described above.

Figure 17:
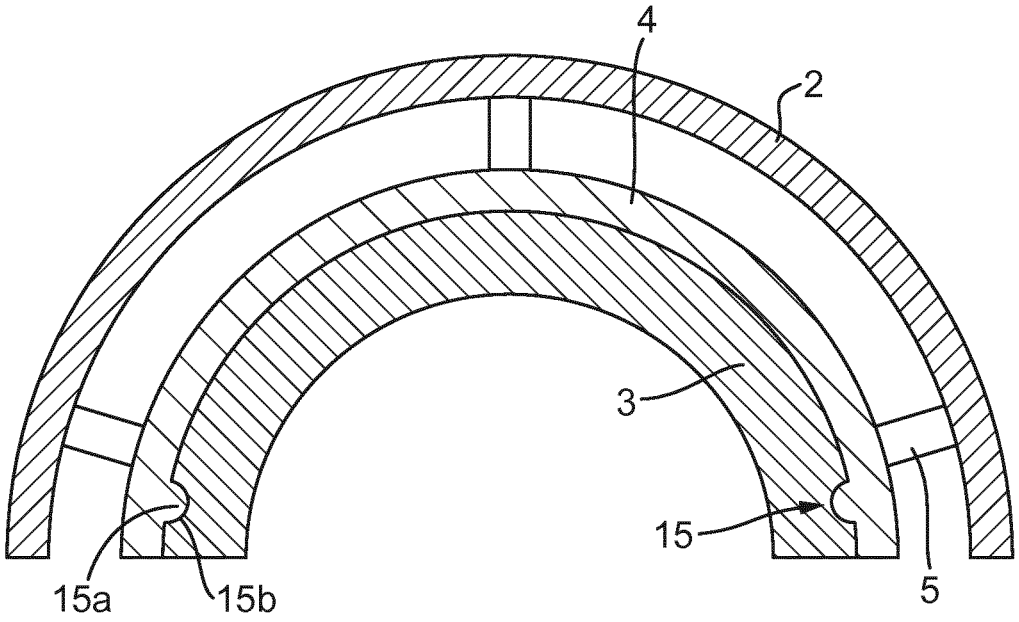
FIG. 17 shows a helmet in accordance with a fourth embodiment.

FIG. 17 shows a fourth embodiment of a helmet 1 in accordance with the present invention. The helmet 1 of the fourth embodiment is similar to the helmet 1 of the third embodiment in most aspects. However, the intermediate layer 4 is detachably connected to the inner shell 3. The detachable connection means between the intermediate layer 4 and the inner shell 3 may be the same as described above in relation to FIGS. 7 to 14 between the intermediate layer 4 and the outer shell 3. Accordingly, the convex portions and concave portions (or through holes) described in relation to FIG. 7 and FIG. 8 may be provided on the intermediate layer 4 and the inner shell 3. In other words, "outer shell 2" may be replaced by "inner shell 3" in the description corresponding to the examples of FIGS. 7 to 14.

Figure 18:
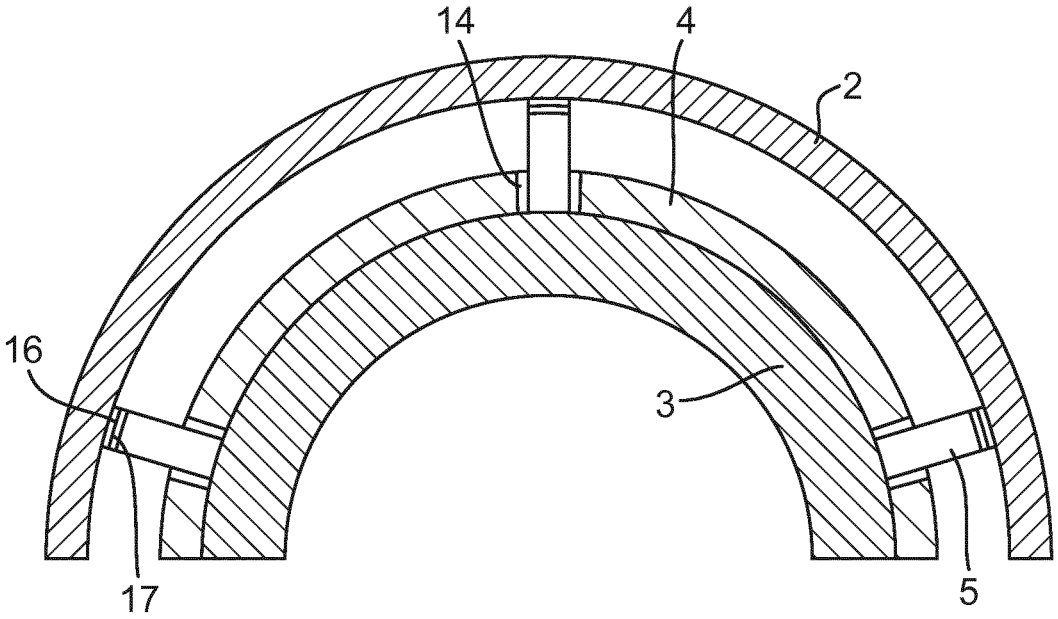
FIG. 18 shows a helmet in accordance with a fifth embodiment.

FIG. 18 shows a fifth embodiment of a helmet 1 in accordance with the present invention. The helmet 1 of the fifth embodiment is similar to the helmet 1 of the first embodiment in most aspects. However, the connecting members 5 directly connect the inner shell 3 to the outer shell 2 when the outer shell 2 is attached to the helmet 1 instead of directly connecting the inner shell 3 and the intermediate layer 4. For example, the outer shell 4 may be detachably connected to the connecting member 5. Such an arrangement may be advantageous in that the connecting member has dual functionality, namely providing a connection that allows sliding and acting as a detachable attachment point for the helmet. This may mean the helmet requires fewer different parts so is more easily manufactured.

As shown in FIG. 18, the intermediate layer 4 may have a hole 14 associated with each of the at least one connecting members 5. The helmet 1 may be configured such that each connecting member 5 between the inner 3 and outer shell 2 passes through the associated hole 14. Such an arrangement may be advantageous in that the helmet can be constructed simply as the intermediate layer can be arranged around the connecting members. Each hole 14 may be large enough to allow sliding between the inner shell 3 and the outer shell 2 during an impact without a connecting member 5 passing through it making contact with the edge of the hole 14. This arrangement may be advantageous as sliding can be provided to the maximum extent permitted by the connecting members.

The connecting members 5 may be detachably attached to the outer shell 2 by a hook and loop detachable connecting means, e.g. Velcro™. However, any other suitable means may be used, for example, snap fit connection means. The hook and loop detachable connecting means comprises a looped part 16 and a hooked part 17. As shown in FIG. 18 the looped part 16 may be attached to the connecting member 5 and the hooked part 17 may be attached to the outer shell 2. However, the opposite arrangement is equally suitable. The hooks of the hooked part 16 hook into the loops of the looped part 17 to provide a detachable connection. The looped part 16 and hooked part 17 may be attached to the connecting member 5 and outer shell 2 respectively by any suitable means, e.g. adhesive. The connecting means 5 may be attached to the inner shell 3 by any suitable means, e.g. adhesive.

In a modification of the fifth embodiment shown in FIG. 17, the inner shell 3 may be detachably connected to the connecting members 5, in the same way as described above. The connecting means 5 can be attached to the outer shell 2 by any suitable means, e.g. adhesive. Alternatively, both the inner shell 3 and outer shell 2 may be detachably connected to the connecting members 5, as described above.

As shown in FIG. 18, a sliding interface may be provided between the intermediate layer 4 and the outer shell 2. The helmet 1 may be configured such that intermediate layer 4 remains in a fixed position relative to the inner shell 3 during an impact. The intermediate layer 4 can be fixed to the inner shell 3 by any suitable means, e.g. adhesive.

Figure 19:
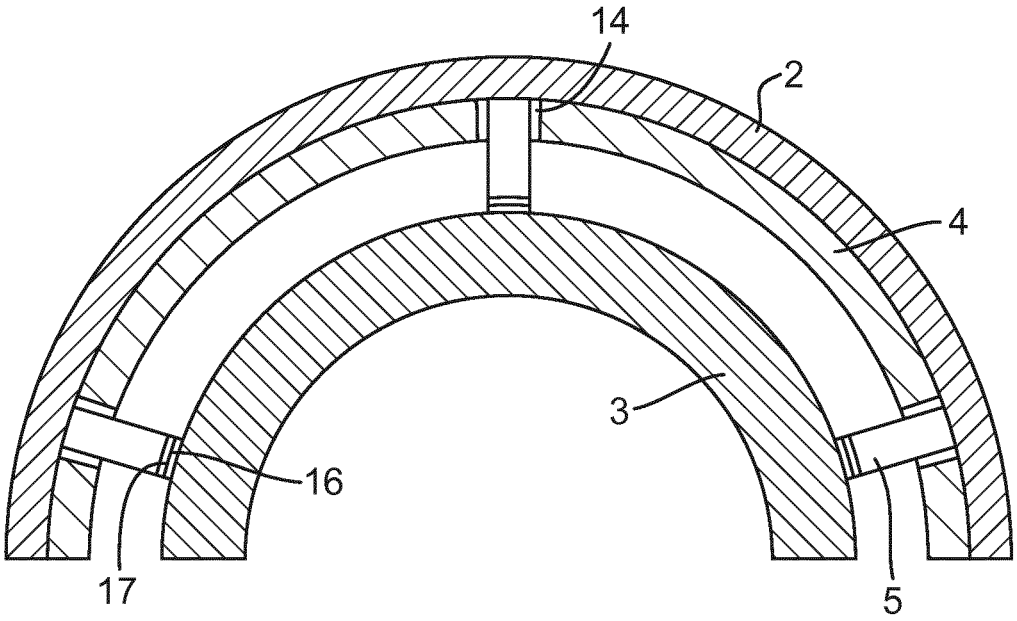
FIG. 19 shows a helmet in accordance with a modification of the fifth embodiment.

As shown in FIG. 19, the sliding interface may be provided between the intermediate layer 4 and the inner shell 2. The helmet 1 may be configured such that intermediate layer 4 remains in a fixed position relative to the outer shell 3 during an impact. The intermediate layer 4 can be fixed to the outer shell 2 by any suitable means, e.g. adhesive.

Figure 20:
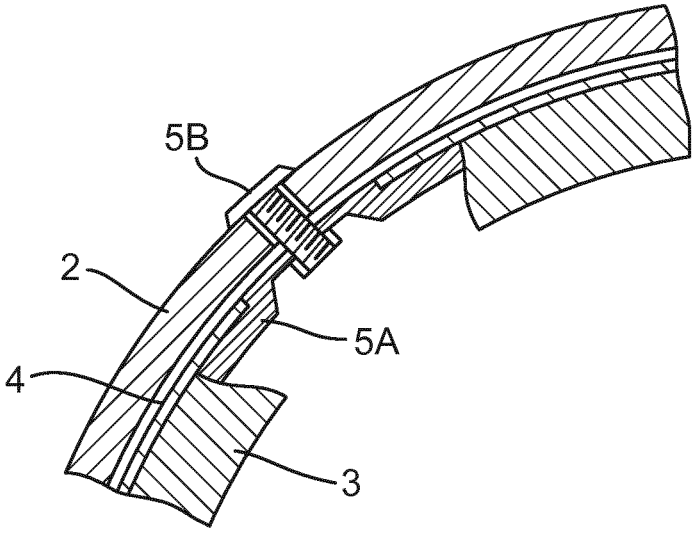
FIG. 20 shows a helmet in accordance with a further modification of the fifth embodiment.

FIG. 20 shows a further modification of the fifth embodiment. As shown in FIG. 20 the connecting member is comprised of two parts 5A, 5B. A first part 5A is provided more inward than the intermediate layer 4 (i.e. closer to the wearer's head) and a second part 5B passes through the intermediate layer 4 (via a through hole, for example) to connect the first part 5A to the outer shell 2. The first part 5A connects directly to the inner shell 3 and is configured to allow sliding between the inner shell 3 and the outer shell 2. For example the first part 5A may be deformable. The outer shell 2 can be detached from the helmet by disconnecting the second part 5B from the first part 5A. The first and second parts 5A, 5B together may form a detachable connecting means.

As shown in FIG. 20, the second part 5B may comprise a bolt or screw passing through the outer shell 2. As shown in FIG. 20, the first part 5A may be positioned within a recess or cut-out in the inner shell 3 and may attach to the inner shell 3 in a direction parallel to the extension direction of the inner shell 3, e.g. by a press-fit arrangement.

The intermediate layer 4 may be fixed in position relative to the outer shell 2 by being clamped between the first part 5A and the outer shell 2. Sliding occurs at an interface between the intermediate layer 4 and the inner shell 3.

Further embodiments are possible in which more than one sliding interface is provided. For example, a sliding interface may provided between the intermediate layer 4 and both the inner shell 3 and the outer shell 4.

In a sixth embodiment a sliding interface is provided between the intermediate layer 4 and both the inner shell 3 and the outer shell 4. In this embodiment, at least one first connecting member 5 directly connects the outer shell 2 to the intermediate layer 4, and at least one further, second connecting member 5 directly connects the inner shell 3 to the intermediate layer 4. At least one of the first and second connecting members 5 may be detachably connected to the intermediate layer 4 and/or at least one of the first and second connecting members 5 may be detachably connected to the inner shell 3 and outer shell 2, respectively. The detachable connection between the connecting members 5 and the intermediate layer 4, inner shell 3, or outer shell 2 may be as described above in relation to the second and third embodiments.

In a seventh embodiment, a sliding interface is provided between the intermediate layer 4 and both the inner shell 3 and the outer shell 4. In this embodiment, the connecting members 5 directly connect the inner shell and outer shell 2 through holes in the intermediate layer 4, as described above in relation to the fifth embodiment and FIG. 18 and FIG. 19. However, in the seventh embodiment, the sliding layer may not be fixed relative to either of the inner shell 3 or the outer shell 2. The intermediate layer 4 may not be fixed to any other part of the helmet. The intermediate layer 4 may be held in place by the connecting members 5 passing through the holes 14.

Variations of the above described embodiment are possible in light of the above teachings. It is to be understood that the invention may be practised otherwise than specifically described herein without departing from the spirit and scope of the invention.

The invention claimed is:

1. A helmet comprising:

an inner shell comprising an energy absorbing material configured to absorb impact energy by compression;

an outer shell;

an intermediate layer between the inner shell and the outer shell formed from or coated with a low friction material; and at least one connecting member configured to connect the inner shell to the outer shell, and allow sliding between the inner shell and the outer shell, when the outer shell is attached to the rest of the helmet;

wherein:

when the outer shell is attached, the outer shell and the inner shell are configured to slide relative to one another in response to an impact, a sliding interface being provided between the intermediate layer and one or both of the outer shell and the inner shell at which the outer shell and/or inner shell are configured to slide against the intermediate layer;

the connecting member is configured to directly connect the inner shell to the outer shell;

the intermediate layer has a hole associated with each of the at least one connecting members and the helmet is configured such that each connecting member between the inner and the outer shell passes through the associated hole, each hole is large enough to allow sliding between the inner shell and the outer shell during an impact without a connecting member passing through it making contact with an edge of the hole; and at least one of the inner shell and the outer shell is detachably connected to the at least one connecting member such that the outer shell is detachable from the inner shell.

2. The helmet of claim 1, wherein a sliding interface is provided between the intermediate layer and the outer shell; and the helmet is configured such that the intermediate layer remains in a fixed position relative to the inner shell during an impact.

3. The helmet of claim 1, wherein a sliding interface is provided between the intermediate layer and the inner shell; and the helmet is configured such that the intermediate layer remains in a fixed position relative to the outer shell during an impact.

4. The helmet of claim 1, wherein the at least one connecting member is deformable to permit sliding between the inner shell and the outer shell.

5. The helmet of claim 1, wherein a sliding interface is provided between the intermediate layer and both the inner and outer shells.

6. The helmet of claim 1, wherein the outer shell is formed from a hard material relative to the inner shell.

7. A helmet comprising:

an inner shell;

a detachable outer shell;

an intermediate layer between the inner shell and the outer shell, wherein the intermediate layer is formed from or coated with a low friction material against which the outer shell and/or inner shell are configured to slide;

a first member connecting one of the inner shell and the outer shell to the intermediate layer outer shell, and configured to allow sliding between one of the inner shell and the outer shell and the intermediate layer, when the outer shell is attached to the rest of the helmet; and a second connecting member connecting the other of the inner shell and the outer shell to the intermediate layer, and wherein, when the outer shell is attached, the outer shell and the inner shell are configured to slide relative to one another in response to an impact, a sliding interface being provided between the intermediate layer and one or both of the outer shell and the inner shell.

8. The helmet of claim 7, wherein the first connecting member connects the inner shell to the intermediate layer.

9. The helmet of claim 8, wherein the outer shell is detachably connected to the intermediate layer.

10. The helmet of claim 8, wherein at least one of the inner shell and the intermediate layer is detachably connected to the first connecting member.

11. The helmet of claim 7, wherein the first connecting member connects the outer shell to the intermediate layer and the intermediate layer is detachably connected to the inner shell.

12. The helmet of claim 11, wherein at least one of the outer shell and the intermediate layer is detachably connected to the first connecting member.

13. The helmet of claim 7, wherein the intermediate layer is detachably connected to the inner shell.

14. The helmet of claim 7, wherein the second connecting member is configured to fix the position of the intermediate layer relative to the other of the inner shell and the outer shell, when the outer shell is attached to the rest of the helmet.

15. The helmet of claim 7, wherein the second connecting member is configured to allow sliding between the intermediate layer and the other one of the inner shell and the outer shell, when the outer shell is attached to the rest of the helmet.

16. The helmet of claim 7, wherein the at least one first connecting member is deformable to permit sliding between the inner shell and the outer shell.

17. The helmet of claim 7, wherein the outer shell is formed from a hard material relative to the inner shell.

18. The helmet of claim 7, wherein the inner shell comprises an energy absorbing material configured to absorb impact energy by compression.

19. The helmet of claim 7, wherein the first and second connecting members form respective parts of a two-part connecting member and the first and second connecting members additionally detachably connect to each other.

20. The helmet of claim 19, wherein the two-part connecting member is configured such that the outer shell can be detached from the rest of the helmet by disconnecting first and second members from each other.

* * * * *